United States Patent [19]

Terkelsen et al.

[11] 4,244,551

[45] Jan. 13, 1981

[54] COMPOSITE SHELL MOLDS FOR THE PRODUCTION OF SUPERALLOY CASTINGS

[75] Inventors: Bruce E. Terkelsen, Cheshire; Michael Cybulsky, Manchester, both of Conn.; James S. Perron, Hudson, Ohio

[73] Assignee: United Technologies Corporation, Hartford, Conn.

[21] Appl. No.: 920,753

[22] Filed: Jun. 30, 1978

Related U.S. Application Data

[63] Continuation of Ser. No. 751,005, Dec. 15, 1976, abandoned, which is a continuation-in-part of Ser. No. 561,711, Mar. 25, 1975, abandoned.

[51] Int. Cl.[2] ..... B28B 7/34

[52] U.S. Cl. ..... 249/134; 106/38.9; 106/38.3; 164/25; 164/41; 249/114 R

[58] Field of Search ..... 106/38.3, 38.35, 38.9; 164/12, 16, 25, 41; 249/134

[56] References Cited

U.S. PATENT DOCUMENTS

| | | | |
|---|---|---|---|
| 1,831,555 | 11/1931 | Earl | 260/40 R |
| 2,912,729 | 11/1959 | Webb | 106/38.9 |
| 2,928,749 | 3/1960 | Watts | 106/38.3 |
| 2,945,273 | 7/1960 | Herzmark et al. | 106/38.3 |
| 3,179,523 | 4/1965 | Moren | 106/38.35 |
| 3,196,505 | 7/1965 | Moren | 106/38.35 |
| 3,260,505 | 7/1966 | Ver Snyder | 75/171 |
| 3,590,905 | 7/1971 | Watts et al. | 425/200 |
| 3,677,747 | 7/1972 | Lund et al. | 75/171 |
| 3,686,006 | 8/1972 | Horton | 106/38.3 |
| 3,711,337 | 1/1976 | Sullivan et al. | 75/171 |
| 3,752,681 | 8/1973 | Moore | 106/38.3 |
| 3,754,945 | 8/1973 | Moore | 106/38.3 |

*Primary Examiner*—Lorenzo B. Hayes
*Attorney, Agent, or Firm*—Charles E. Sohl

[57] ABSTRACT

Composite ceramic shell molds for investment casting and subsequent directional solidification of nickel and cobalt base superalloys is described. The composite ceramic shell mold is composed of an inner component having an alumina content of at least 80 percent and an average thickness of about ten mils and an outer layer composed predominantly of zircon having a thickness of from 0.1 to 0.4 inches. The alumina component of the shell mold is wet by the superalloy material and this wetting action is believed to cause the substantial elimination of a surface defect problem known as chain porosity. The zircon component of the shell mold had desirable mechanical properties and may easily be removed from the solidified casting. The alumina and zircon components are bonded together in such a fashion that they will not separate during the casting process.

3 Claims, 1 Drawing Figure

200X

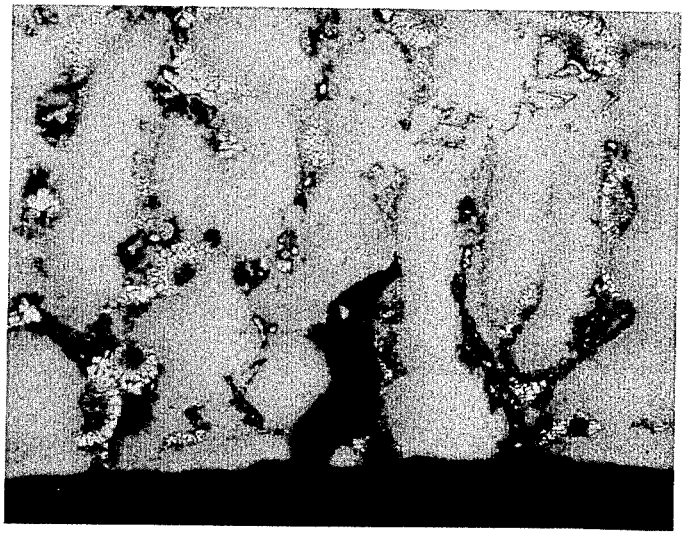
200 X

COMPOSITE SHELL MOLDS FOR THE PRODUCTION OF SUPERALLOY CASTINGS

This is a continuation of U.S. Ser. No. 751,005, filed on Dec. 15, 1976 which is in turn a continuation in part of U.S. Ser. No. 561,711 filed Mar. 25, 1975 which both are now abandoned.

BACKGROUND OF THE INVENTION

Investment casting, also referred to as the lost wax process, is a casting process which is particularly suited for the production of small metal parts having a high degree of dimensional accuracy. The investment casting process is widely used for the fabrication of blades and vanes for gas turbine engines. Articles produced by this process have the advantage of requiring only minimal processing following casting. This process is discussed in U.S. Pat. Nos. to Earl, 1,831,555; Watts, 3,590,905; Horton, 3,686,006, and Moren, 3,179,523 and 3,196,505.

Turbine efficiency is closely related to operating temperature. Demands for improved efficiency have resulted in the development of more heat resistant alloys. Surface condition also affects high temperature life and it is important that the finished casting have a good surface condition, one which is free from defects which may cause subsequent failures.

A technique which has been employed to improve the high temperature properties of superalloys is directional solidification. In this technique a molten casting slowly solidified at a controlled rate so that the interface between the molten and solidified portions of the alloy passes slowly along the longitudinal axis of the part. One result of this technique may be to produce a series of columnar grains with the longitudinal axis of the grains being oriented with the longitudinal axis of the casting. Improved longitudinal high temperature properties are obtained as a result of the reduction in grain boundary area perpendicular to the longitudinal axis. This technique is described in the VerSnyder U.S. Pat. No. 3,260,505 which is assigned to the present assignee.

In the past, a common problem with nickel base superalloys used at elevated temperatures was a lack of ductility at intermediate temperatures such as about 1400° F. This lack of ductility was responsible for many failures of turbine parts. It was discovered that the addition of small amounts of hafnium to nickel base superalloys greatly improved the intermediate temperature of these alloys. Additionally such hafnium additions were found to improve the transverse mechanical properties of the castings. The addition of hafnium to superalloys is discussed in U.S. Pat. Nos. 3,677,747 and 3,711,337.

A casting defect has been observed in these hafnium containing alloys which has not previously been noted in superalloys. This defect is a surface defect having a resemblance to a crack or hot tear. The defect has been given the name chain porosity. This defect is found in castings having a change in cross sectional area of at least 1:2 in the vicinity where the change in cross section occurs. When the moving solidification interface passes from a portion of the casting having a small cross sectional area to a portion of the casting having a larger cross sectional area it is believed that a condition arises which leads to the formation to the surface defect in the partially solidified casting. Careful studies of the defect reveal that it has a crack-like morphology and that the root portion of the crack contains hafnium/hafnium oxide. Although chain porosity has only been observed in hafnium containing alloys, those skilled in the art will appreciate that the problem may arise in the future in alloys which do not contain hafnium as more advanced alloys are developed.

Accordingly it is the purpose of the present invention to disclose a mold which may be used for the directional solidification of nickel base superalloys which will substantially eliminate the problem known as chain porosity. A further object of the present invention is the description of the technique useful in producing composite molds useful for the elimination of chain porosity in nickel base superalloy castings.

DESCRIPTION OF THE PREFERRED EMBODIMENTS

The mold of the present invention is a composite mold having an inner component comprised predominantly of alumina and an outer component comprised predominantly of zircon. The inner alumina component interacts with the molten and partially solidified metal in such a way as to reduce and eliminate chain porosity. The outer zircon component has desirable mechanical properties both before and after casting and easily removed from the finished part. The mold of the present invention may easily be produced using conventional equipment. Since the mold is predominantly zircon which is the material presently used to produce investment casting molds, the thermal expansion characteristics will be similar to those of the molds presently used. Accordingly, the patterns used to produce present molds will produce dimensionally satisfactory molds using the process of the present invention.

The mold of the present invention has an inner component comprised of at least 80 percent alumina having a thickness of from 2 to 20 mils. The inner component also contains silica which serves as a binder. The sum of the alumina and silica components must excede 90%. The outer component is comprised predominantly of zircon and has a thickness of from 0.1 to 0.4 inches. Because alumina and zircon have different coefficients of thermal expansion the thickness of the inner component must be carefully maintained within the previously described limits. If the thickness of the inner component varies outside of these limits satisfactory performance will not be obtained and it is quite probable that the inner alumina component will crack or will spall away from the outer zircon component.

The exact cause of chain porosity is not known and therefore the way in which the alumina component eliminates chain porosity is not known, however, it has been observed that the alloys in question, nickel base superalloys which contain hafnium, wet alumina to a much greater extent than they wet zircon. It is believed that this difference in wetting significantly changes the heat transfer coefficient from the mold to the molten metal and this change in heat transfer coefficient quite likely changes the shape of the interface between the solid and molten metal. It is believed that this change in interface shape is responsible for the elimination of the chain porosity problem. A minor drawback which has been encountered in the use of an alumina mold surface is that some slight reaction occurs between the molten metal and the alumina. This reactivity is somewhat implicit since the fact that the alumina is wet by the molten material implies some chemical affinity between the mold material and the molten metal. This slight reaction between the mold and the metal has not been found to be deleterious and can be completely removed by a sandblasting treatment and/or etching treatment. Such reaction is entirely confined to the outer most layer of a casting and the maximum depth of reaction has been found to be not greater than 0.5 mil. Although it might seem that the problem to which the present invention is addressed might be solved through the use of a shell comprised completely of alumina this is not the case. An all alumina shell becomes extremely strong and hard after it is heated to elevated temperatures by the molten metal. This strength is retained at room temperature and as a result it is difficult if not impossible to remove such a shell from the solidified casting. In addition, since alumina has a different coefficient of thermal expansion, use of alumina molds would require an expensive redesign of existing patterns. The dimensional equivalence of the mold of the present invention with the prior art molds is of great commercial significance. Through the use of the composite mold of the present invention a desirable combination of the attributes of both the zircon shell and alumina shell may readily be obtained. The resultant shell has adequate mechanical properties for the loads and stresses applied during the casting process but is weak enough to be readily removed from the solidified casting. The thickness and composition of the alumina component are critical to the proper functioning of the mold. In its final dried form, the alumina component of the mold must contain at least 80% alumina if satisfactory results are to be obtained. Silica is the preferred binder, and the sum of the alumina and silica should excede 90%. The average thickness of the inner component must be restricted to the range of 2 to 20 mils and this restriction can be satisfied through the selection of the slurry components from which the alumina component is fabricated. The thickness of the alumina component or prime coat is largely determined by the viscosity and density of the slurry. For proper results the viscosity of the slurry must be from 13 to 19 seconds as measured in a #4 Zahn cup at 75° F. Two further restrictions are that the specific gravity of the slurry must lie in the range of 2.45 to 2.60 and the PH must be between 9 and 10. This is in conjunction with forced drying, as those skilled in the art know that with air dried shells these parameters can vary. As an alternate embodiment, a plurality of prime coats using a lower viscosity slurry may be employed to achieve an inner layer of a satisfactory thickness.

Within the restrictions set forth above we have obtained particularly satisfactory results with an alumina containing slurry described below: In the following description all parts are by weight and include the water necessary to obtain the desired viscosity. From 20 to 30 parts of a 30 percent aqueous solution of colloidal silica, from 50 to 70 parts of alumina having a particle size of −325 mesh, from 10 to 15 parts of alumina having a particle size −400 mesh, from 4 to 8 parts of alumina having a particle size of −100 mesh and from 0 to 5 parts of kyanite having a −100 mesh particle size. We have found that the addition of from 1 to 5 parts of cobalt aluminate to the slurry mixture produces a significant improvement in surface finish. The cobalt aluminate addition is preferred, but not required. In the preceding description the colloidal silica component is a binder which insures strength and adherence of the alumina component. At high temperatures the silica reacts with the alumina to form complex aluminates which bond the alumina particles together. The particular selection of mesh sizes given above has produced extremely satisfactory results in that an alumina component produced with this slurry has an exceptional combination of mechanical properties and good surface finish. It will be appreciated by those skilled in the art that the exact combination of particle size and distribution of particle sizes in a slurry has a significant effect on viscosity and density. A slurry made according to the previous description has a density and viscosity falling within the limits previously described.

Alumina occurs in a wide variety of crystal structures and particle sizes. Examples of different types of alumina include tabular alumina, fused alumina and calcined alumina. As a general rule these types of alumina are broadly interchangeable in the production of the present invention. However, a particularly preferred embodiment is set forth below in Example III.

The present invention will be made more clear through consideration of the following illustrative examples which deal with the production of experimental nickel base superalloy castings in a variety of types of shell molds. The alloy used has a nominal composition of 9% chromium, 10% cobalt, 12.5% tungsten, 1% columbium, 2% titanium, 5% aluminum, 2% hafnium, 0.015% boron, 0.1% carbon, balance essentially nickel. This alloy was cast from a temperature of about 2800° F. into a variety of molds described below having an internal shape corresponding to that of a turbine blade. In the molds the blade section which had a smaller cross sectional area than the root section as located beneath the root section so that during directional solidification the solidification front passed from the small cross sectional area of the blade to the larger cross sectional area of the root. When chain porosity was encountered it was located in the near area of change in cross section. The castings were solidified at a rate of approximately 8 inches per hour using a withdrawal technique in which the mold was withdrawn from the furnace at a rate of about 8 inches per hour. All molds were produced using a conventional shell mold preparation technique which basically involves dipping a wax pattern into a ceramic slurry and applying a relatively coarse dry ceramic material (called stucco) to the wet slurry surface. This procedure is followed a number of times with intermediate drying steps until a desired mold thickness is built up.

EXAMPLE I

Conventionally all zircon molds were produced using the technique described above. The details of the compositions of the different slurries and dry ceramic mixtures are given in Table I. Several molds were produced and test castings were made using these molds. A very high incidence of chain porosity was observed and a representative photomicrograph showing this chain porosity is shown in FIG. 1. FIG. 1 shows a chain porosity having a depth of approximately 10 mils into the body of the blade. Such a defect is obviously detrimental to the strength and useful life of an article such as the turbine blade which is subject to high stresses at elevated temperatures.

EXAMPLE II

Several composite molds were produced according to the present invention using the slurry and stucco sequence shown in Table II. Identical castings were made in these molds. These castings were found to be characterized by a complete absence of chain porosity. The molds were easily removed from the castings following solidification and the surface of the castings was easily cleaned using conventional abrasive techniques. The alumina slurry composition described in Table II has given excellent results and is a preferred embodiment.

EXAMPLE III

An all alumina shell was produced using the stucco and slurry sequence shown in Table III. Castings were successfully made in these molds and showed no evidence of chain porosity, however, the molds were extremely difficult to remove from the solidified casting and the dimensional accuracy of the final castings was not as good as those produced by the mold of the present example in Table II.

EXAMPLE IV

Several composite molds were made according to the details set forth in Table IV. These molds fall within the scope of the invention and differ from those described in Example II only in that they contain one alumina face coat (of slurry #1) rather than two. Castings of the alloy previously described were successfully made in these molds and the castings were found to be free of chain porosity and other serious defects. No problems were encountered in removing the mold from the solidified casting.

Although the invention has been shown and described with respect to a preferred embodiment thereof, it should be understood by those skilled in the art that various changes and omissions in the form and detail thereof may be made therein without departing from the spirit and the scope of the invention.

TABLE I

Zircon Shell Compositions

| Slurry Components (Weight percent) | | | Stucco's | | |
|---|---|---|---|---|---|
| Coat 1 | Coat 2 | Coats 3,4,5 etc. | Coat 1 | Coat 2 | Coats 3,4,5 etc. |
| 19.4% Ludox[1] HS-30<br>24.3% −140 mesh zircon<br>53.9% −325 mesh zircon<br>2.4% Cobalt Aluminate | Identical to 1st coat except that Ludox is added to lower viscosity and density | 22.2% Ludox HS-30<br>77.8% D-180[2] | −80 + 200 mesh zircon | −30 + 60 mesh Molochite[3] | DF-180[4] |

[1]Trade name for 30% Colloidal Silica suspension supplied by Du Pont.
[2]Trade name for material (based on a mullite-zircon mixture) supplied by TRW.
[3]Trade name for calcined china clay supplied by Casting Supply House.
[4]Trade name for material (based on zircon) supplied by TRW.

TABLE II

Composite Shell Compositions

| Slurry Components (Weight percent) | | | Stucco's | | |
|---|---|---|---|---|---|
| Coat 1 | Coat 2 | Coats 3,4,5 etc. | Coat 1 | Coat 2 | Coats 3,4,5 etc. |
| 24.0% Ludox[1] HS-30<br>51.9% −325 mesh Tabular Alumina<br>5.4% −400 mesh Fused Alumina<br>6.2% −100 mesh Tabular Alumina<br>2.3% −100 mesh Kyanite<br>7.9% Unground Calcined Alumina<br>2.3% Cobalt Aluminate | Identical to 1st coat except that Ludox is added to lower viscosity and density | 22.2% Ludox HS-30<br>77.8% D-180[2] | −80 + 200 mesh zircon | −30 + 60 mesh Molochite[3] | DF-180[4] |

[1]Trade name for 30% Colloidal Silica suspension supplied by Du Pont.
[2]Trade name for material (based on a mullite-zircon mixture) supplied by TRW.
[3]Trade name for calcined china clay supplied by Casting Supply House.
[4]Trade name for materials (based on zircon) supplied by TRW.

TABLE III

Alumina Shell Compositions

| Slurry Components (Weight percent) | | Stucco's | | |
|---|---|---|---|---|
| Coat 1 | Coats 2,3,4 etc. | Coat 1 | Coat 2 | Coats 3,4 etc. |
| 24.5% Ludox[1] HS-30<br>53.0% −325 mesh Tabular Alumina<br>5.7% −400 mesh Fused Alumina<br>6.4% −100 mesh Tabular Alumina | 25.9% Ludox HS-30<br>29.7% −325 mesh Tabular Alumina<br>3.7% −100 mesh Tabular Alumina<br>18.5% −48 mesh Tabular Alumina<br>7.4% −28 mesh Tabular | Fused Alumina −70 + 100 mesh | Tabular Alumina −28 + 48 mesh | Tabular Alumina −14 + 28 mesh |

TABLE III-continued

| Alumina Shell Compositions | | | | |
|---|---|---|---|---|
| Slurry Components (Weight percent) | | Stucco's | | |
| Coat 1 | Coats 2,3,4 etc. | Coat 1 | Coat 2 | Coats 3,4 etc. |
| 2.4% −100 mesh Kyanite<br>8.0% Unground Calcined Alumina | Alumina<br>2.2% −100 mesh Kyanite<br>12.6% −48 mesh Mullite | | | |

[1]Trade name for 30% Colloidal Silica suspension supplied by Du Pont.

TABLE IV

| Zircon Shell-Alumina Prime Coat Shell Composition | | | | | |
|---|---|---|---|---|---|
| Slurry Components (Weight percent) | | | Stucco's | | |
| Coat 1 | Coat 2 | Coats 3,4,5 etc. | Coat 1 | Coat 2 | Coats 3,4,5 etc. |
| 24.2% Ludox[1] HS-30<br>52.2% −325 mesh Tabular Alumina<br>5.6% −400 mesh Fused Alumina<br>6.2% −100 mesh Tabular Alumina<br>2.4% −100 mesh Kyanite<br>7.8% Unground Calcined Alumina<br>1.6% Cobalt Aluminate | 19.4% Ludox HS-30<br>24.3% −140 mesh zircon<br>53.8% −325 mesh zircon<br>2.5% Cobalt Aluminate | 22.2% Ludox HS-30<br>77.8% D-180[2] | −80 + 200 mesh zircon | −30 + 60 mesh Molochite[3] | DF-180[4] |

[1]Trade name for 30% Colloidal Silica suspension supplied by Du Pont.
[2]Trade name for material (a mixture of mullite and zircon) supplied by TRW.
[3]Trade name for calcined china clay supplied by Casting Supply House.
[4]Trade name for material (based on zircon) supplied by TRW.

Having thus described a typical embodiment of our invention, that which we claim as new and desire to secure by Letters Patent of the United States is:

1. A composite ceramic shell mold having an internal cavity for producing castings of superalloys which are susceptible to chain porosity, said cavity containing a region where the cross-sectional area changes by a factor of at least 1:2 which comprises:

a. an inner component consisting essentially of alumina and silica, with the alumina composing at least 80% by weight of the component, and the sum of the alumina and silica composing at least 90% by weight of the component, said inner component having an average thickness of about 2 to 20 mils and being wettable by molten superalloys; and b. an outer component consisting essentially of zircon and a colloidal silica binder and having a thickness of from 0.1 to 0.4 inch, said outer component being readily removable from the solidified superalloy casting.

2. A slurry composition useful in the production of ceramic shell molds for the production of superalloy investment castings which comprises:

from 20 to 30 parts of a 30% aqueous solution of colloidal silica;

from 50 to 70 parts of alumina having a particle size of −325 mesh;

from 10 to 15 parts of alumina having a particle size of −400 mesh;

from 4 to 8 parts of alumina having a particle size of −100 mesh; and up to 5 parts of Kyanite having a particle size of −100 mesh.

3. A slurry as in claim 2 which further includes from 1 to 5 parts of cobalt aluminate.

* * * * *